United States Patent [19]

Hatagawa

[11] Patent Number: 4,499,356

[45] Date of Patent: Feb. 12, 1985

[54] MICROWAVE HEATER HAVING A DEVICE FOR THAWING FROZEN CAKES

[75] Inventor: Toyotsugu Hatagawa, Yamatokoriyama, Japan

[73] Assignee: Matsushita Electric Industrial Co., Ltd., Kadoma, Japan

[21] Appl. No.: 481,878

[22] Filed: Apr. 4, 1983

[30] Foreign Application Priority Data

Apr. 7, 1982 [JP] Japan ..... 57-58851

[51] Int. Cl.[3] ..... H05B 6/80

[52] U.S. Cl. ..... 219/10.55 E; 219/10.55 F; 219/10.55 D; 99/DIG. 14; 426/243

[58] Field of Search ..... 219/10.55 E, 10.55 F, 219/10.55 R, 10.55 D, 10.55 B; 99/451, DIG. 14; 126/390; 426/243, 241, 234

[56] References Cited

U.S. PATENT DOCUMENTS

| | | | |
|---|---|---|---|
| 3,470,942 | 10/1969 | Fukada et al. | 219/10.55 B X |
| 3,835,280 | 9/1974 | Gades et al. | 219/10.55 E |
| 3,845,266 | 10/1974 | Derby | 219/10.55 E |
| 4,015,085 | 3/1977 | Woods | 219/10.55 E |
| 4,121,510 | 10/1978 | Frederick | 219/10.55 E X |

*Primary Examiner*—P. H. Leung

*Attorney, Agent, or Firm*—Spencer & Frank

[57] ABSTRACT

A microwave heater for thawing a frozen cake uniformly and in a short time. The frozen cake is placed on a high-frequency transmissive resin tray having at the bottom thereof an aluminum plate, and the cake is covered by a cup-shaped aluminum container. The cup-shaped aluminum container and the aluminum plate are respectively provided with a plurality of apertures, and radiation of microwave energy to the frozen cake is controlled with respect to the amount and direction of its introduction by selecting the sizes and positions of the apertures of the cup-shaped container and the aluminum plate.

2 Claims, 20 Drawing Figures

FIG. 6a
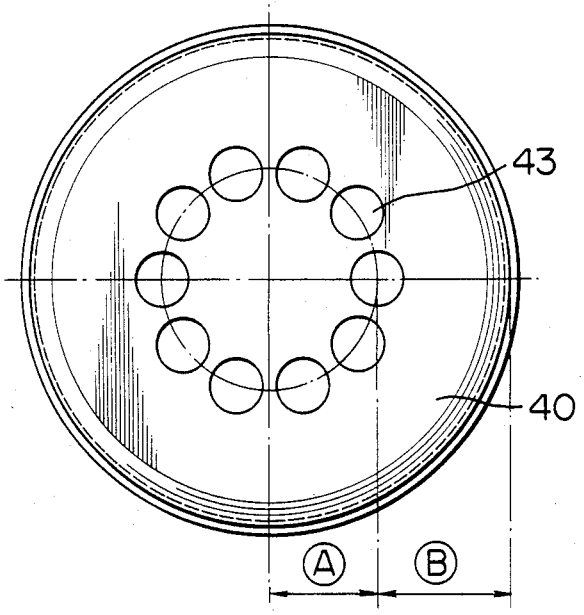
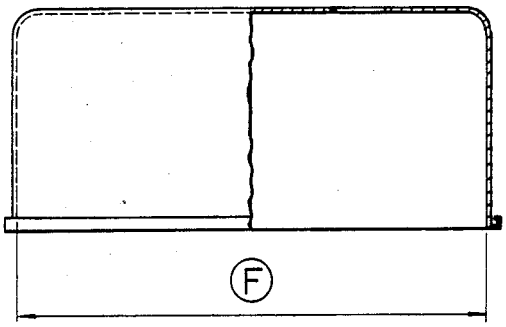
FIG. 6b

MICROWAVE HEATER HAVING A DEVICE FOR THAWING FROZEN CAKES

BACKGROUND OF THE INVENTION

The present invention relates to a microwave heater for thawing frozen food.

Owing to the recent advances in the technology of processing and storing food, frozen food has become increasingly popular, and there have been proposed various methods of thawing frozen food. One method uses microwave energy, and is realized, for example, as a commercial thawer in which food is exposed to microwave energy having a frequency of 13 MHz generated by parallel plane electrodes while cool air is blown over the food. Another method uses microwave energy having a frequency of 2450 MHz, which will now be described with reference to FIGS. 1 and 2. A food 1 is accommodated in a heating chamber 2 which is supplied with cooled air by a cooler 3 and a blower 4 so that the atmosphere in the heating chamber 2 is kept cool thereby preventing the surface of the food 1 from becoming overheated. In addition, in order to avoid excessive thawing at portions of the food 1, such as the corners, the food is covered by a metallic cover 5 having many holes 6 so that the amount of microwave energy radiated from a magnetron 7 to the food 1 is adjusted thereby achieving uniform thawing.

Still another method of thawing frozen food utilizing microwave energy will be described with reference to FIGS. 3 and 4. Microwave energy produced by a magnetron 8 is conducted through a waveguide 9 into a heating chamber 10. Inside the heating chamber 10, an object 11 to be heated is accommodated within an electrically non-conductive container 12 which is covered by an electrically conductive member 13 having microwave transmitting apertures 14. In this arrangement, the amount of microwave energy radiated from the magnetron 8 to the object 11 and the propagation path of the microwave are adjusted by the conductive member 13 having the microwave transmitting apertures 14 thereby achieving satisfactory thawing.

Also in this arrangement the object container 12 is not always positioned at a fixed position with respect to the heating chamber 10 or with respect to the object 11, causing a variation in the electric field applied to the object 11, and this results in uneven thawing for the object which may for example, be frozen cake.

As described above, there have been proposed various methods using microwave energy for use in thawing different forms of frozen food. However, the present invention particularly contemplates provision of an apparatus for thawing a large frozen cake, 20 to 28 cm in diameter, in a short time and with satisfactory result. Conventionally, a frozen cake has been thawed by being left within a refrigerator for 8 to 12 hours, or in the atmosphere at room temperature for 3 to 6 hours.

SUMMARY OF THE INVENTION

In view of the foregoing background situation, the object of the present invention is to provide a microwave heater which operates to thaw a large frozen cake satisfactorily and in a short time.

In order to achieve the object, the microwave heater according to the invention is provided with a cake cover and a cake tray which allow the introduction of microwave energy from above and below the frozen cake. The cake tray is devised so that the heating chamber, the cake and the cake container always have a constant spatial relationship with one another. In addition, the microwave heater operates to generate microwave energy intermittently so that uniform and satisfactory thawing of the frozen cake is always achieved.

BRIEF DESCRIPTION OF THE DRAWINGS

FIGS. 6*a* and 6*b* are top and side views showing in detail the thawing container;

DESCRIPTION OF THE PREFERRED EMBODIMENT

The arrangement of the present invention will now be described with reference to the drawings.

Figure 1:
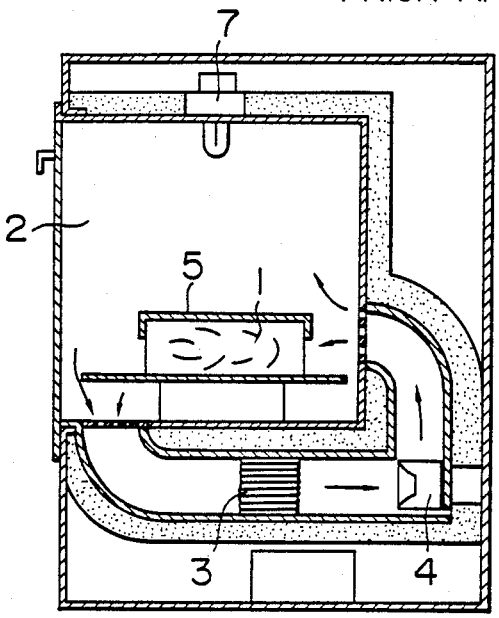
FIG. 1 PRIOR ART
FIG. 1 is a side cross-sectional view showing one prior art microwave heater.
Figure 2:
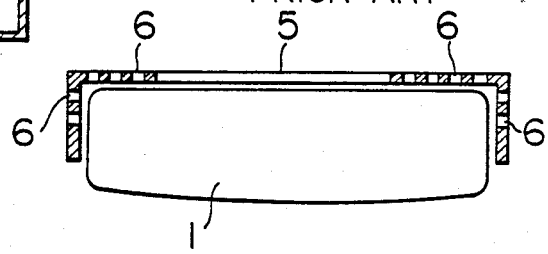
FIG. 2 PRIOR ART
FIG. 2 is a side cross-sectional view of the thawing container used in the above heater.
Figure 3:
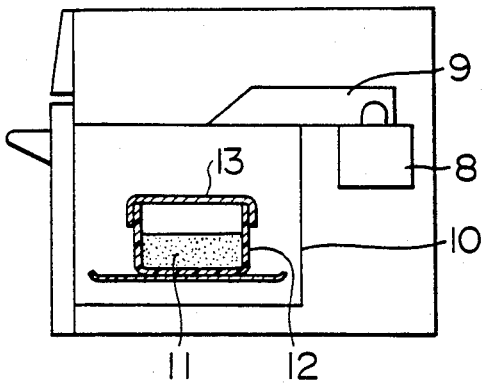
FIG. 3 PRIOR ART
FIG. 3 is a side cross-sectional view showing the second prior art microwave heater.
Figure 4:
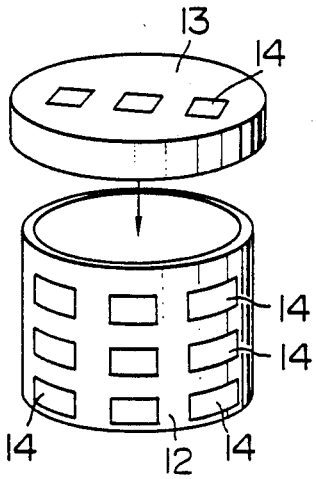
FIG. 4 PRIOR ART
FIG. 4 is a broken perspective view of the thawing container used in the second prior art heater.
Figure 5:
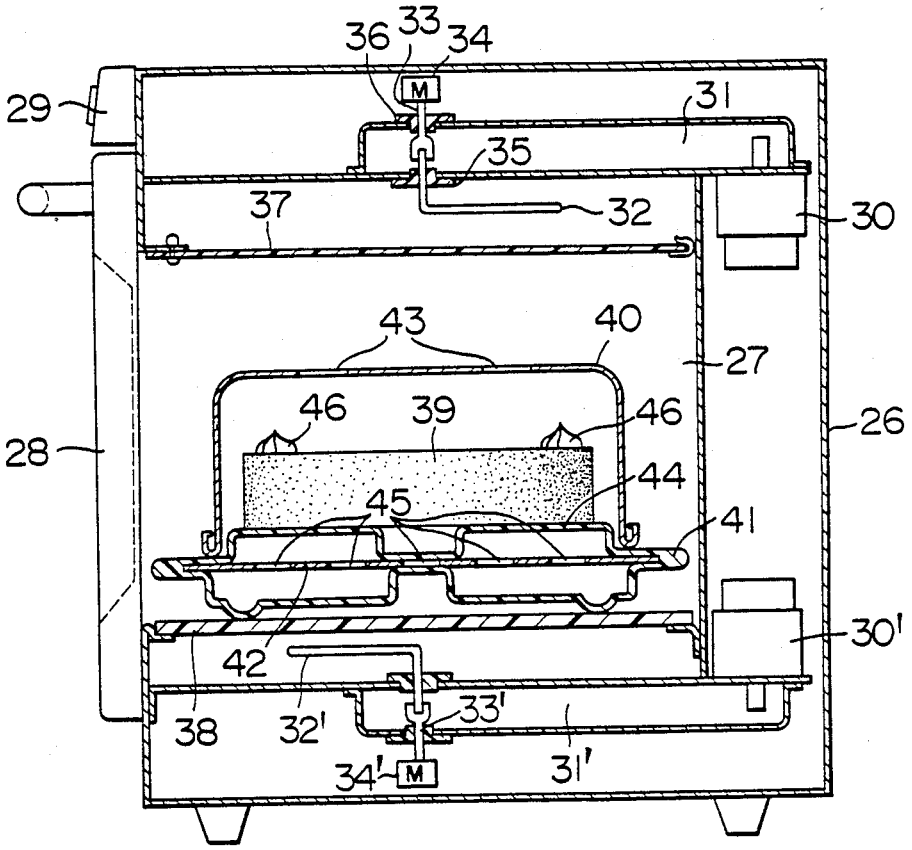
FIG. 5 is a side cross-sectional view showing the microwave heater embodying the present invention.

FIG. 5 shows the side cross-section of one embodiment of the present invention, where the arrangement includes an outer enclosure 26, a heating chamber 27 which accommodates an object 39 to be heated, a door 28 for closing the front opening of the heating chamber 27, a control panel 29 with a timer knob and operation buttons attached thereon, and magnetrons 30 and 30' for supplying microwave energy to the heating chamber 27. The microwave energy emitted from the magnetrons 30 and 30' is conducted by waveguides 31 and 31' and radiated into the heating chamber 27 by rotary antennas 32 and 32' provided at the microwave entry ports. Each of the rotary antennas 32 and 32' has at one end a drive shaft 33 (33') made of resin and connected to a motor 34 (34') so that it is rotated by the motor 34 (34'). Reference number 35 denotes a bearing for the rotary antenna 32, 36 is the bearing for the drive shaft 33, and 37 is a separation board for separating the heating chamber 27 from the rotary antenna housing space.

There is also provided a separation board 38 made of glass or ceramic at the bottom of the heating chamber 27, a lower microwave feeding section including the waveguide 31', rotary antenna 32', etc. having the same structure as the upper microwave feeding section including the waveguide 31, and rotary antenna 32, etc., both feeding sections being in symmetrical relationship. The object 39, which may be a frozen cake, is placed in the heating chamber 27 and is accommodated within a thawing container made up of a cup-shaped container 40, a cake tray 41 and a microwave control plate 42 as shown in the figure. The cup-shaped container 40 is made of a metallic material such as stainless steel or aluminum for blocking the microwave energy except for the top where apertures 43 for introducing the microwave energy are formed. The cake tray 41 is made of a microwave-transmittable material with low high-frequency loss such as polypropylene, and has a substantially square shape with an annular protrusion 44 formed at the central portion. The microwave control plate 42 serves to adjust the microwave energy entering from below the thawing container, and is made of a metallic material such as stainless steel or aluminum with apertures 45 for properly introducing microwave energy into the container.

The microwave control plate 42 and the cake tray 41 are formed integrally with complete sealing, and therefore no residual of food can enter the cake tray 41. This complete sealing allows the tray 41 to be washed in a dish washer, providing ease of handling. For thawing the frozen cake 39, it is placed on the cake tray 41 outside of the heating chamber 27, the cup-shaped container 40 is placed over the tray 41, and then the tray 41 with the cake 39 covered by the container 40 is placed in the heating chamber 27.

The frozen cake 39 is thawed by the microwave heater with the structure as described above. The following will describe in more detail the functions of the thawing container 40, 41 and 42.

The cake 39 is usually frozen at a temperature of around −20° C. When the cake is thawed up to a temperature of −3° to −5° C., it can be cut into pieces without damaging the shape, and the pieces of cake are ready to serve when they are further thawed up to a temperature of around 5° C. The cake 39 is principally made of fresh-cream and butter-cream, and if the cake 39 is heated in excess, the cream will melt, and the cake 39 will be deformed and can no longer be sold. Therefore, it is necessary to thaw the whole cake uniformly. The thawing process using microwave energy tends to heat excessively protruding decoration and corner section portions of the cake 39.

Figure 9:
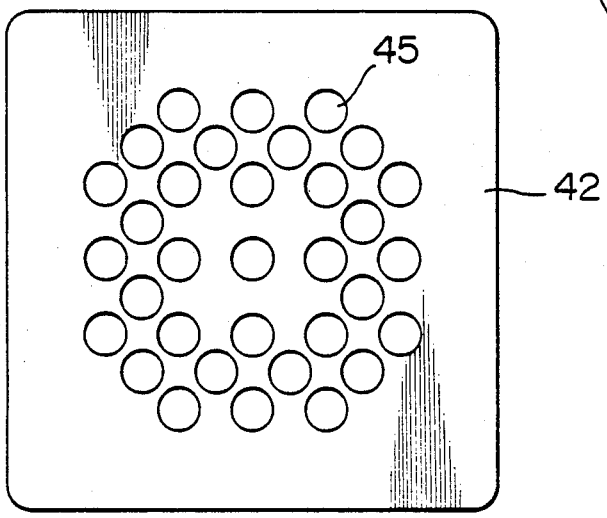
FIG. 9 is a diagram showing in detail the microwave controlling plate.
Figure 10A:
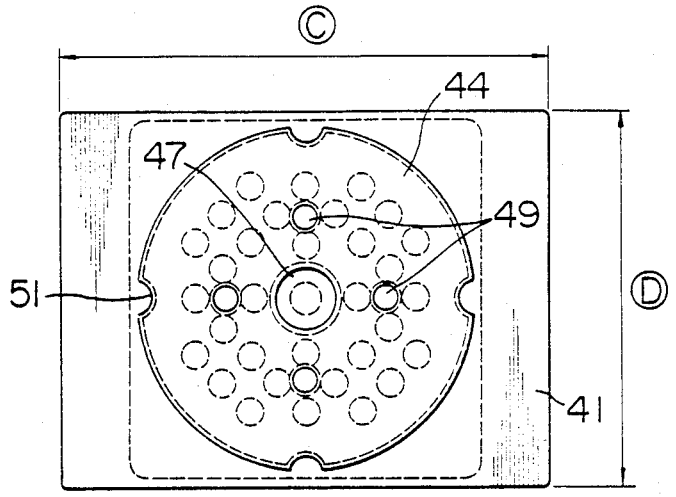
FIGS. 10*a*–10*c* are diagrams showing in detail the cake tray.
Figure 10B:
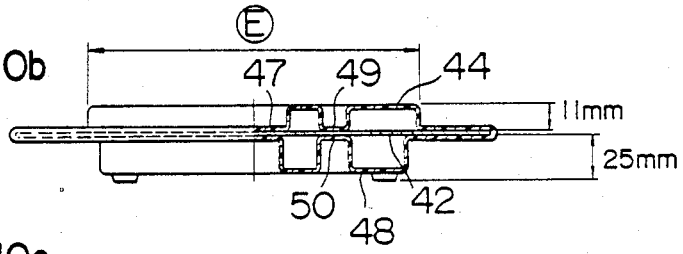
Figure 10C:
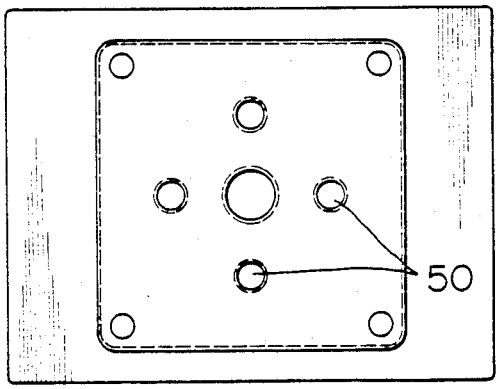

First, the functions of the cup-shaped container 40 and microwave control plate 42 will be described. If a bare frozen cake 39 were to be thawed in the heating chamber 27, decorations 46 would surely be melted before the temperature of the whole cake 39 could rise. This is because the protruding decorations 46 are highly susceptible to absorption of microwave energy. The purpose of using the cup-shaped container 40 and microwave control plate 42 is to prevent such undesirable result. On the other hand, the introduction of microwave energy from the side of the cake 39 tends to heat in excess the side or the corner section of the cake 39. According to the present invention, as shown in FIG. 5, the cup-shaped container 40 is provided with apertures 43 only in the top section while its side section is closed completely so that the microwave energy is introduced only from above and below the cake 39. The details of the cup-shaped container 40 are shown in FIGS. 6*a* and 6*b*. The microwave control plate 42 is provided with apertures 45 in the central portion with respect to the cake 39 so that the microwave energy does not go to the side of the cake 39. The details of the microwave control plate 42 are shown in FIG. 9. The areas of the apertures 43 and 45 in the cup-shaped container 40 and microwave control plate 42 are determined appropriately depending on the intensity of the electric field in the heating chamber 27 so that the microwave energy is introduced evenly into the top and bottom of the cake 39.

Figure 7:
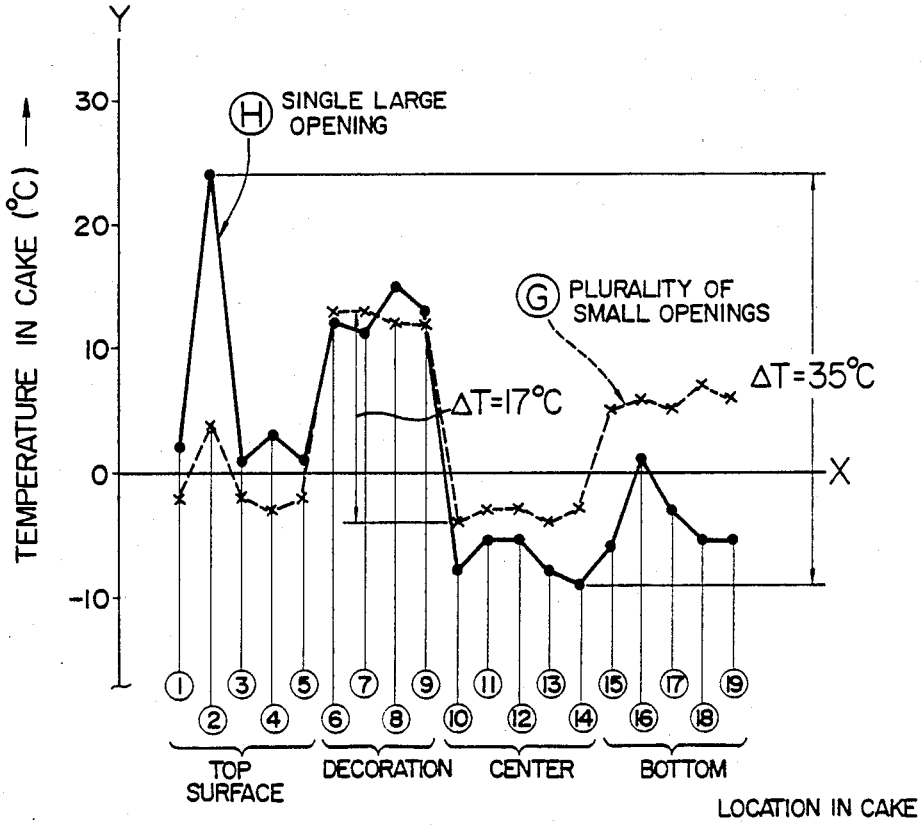
FIG. 7 is a graph showing the result of the thawing test for comparing different sizes and number of opening in the container.
Figure 8:
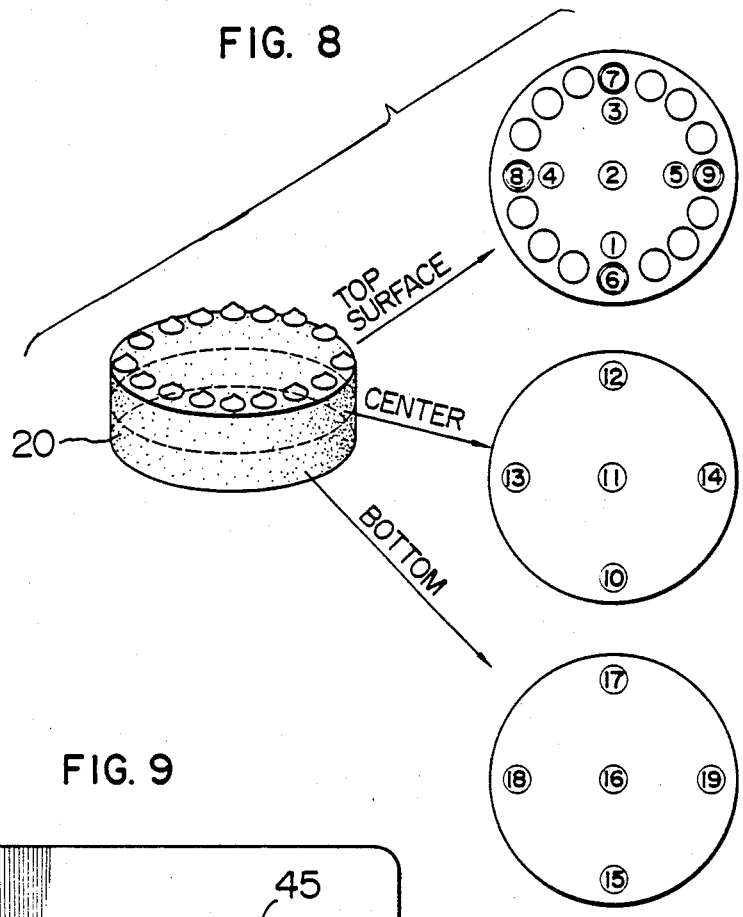
FIG. 8 is an illustration of a cake showing the temperature measurement points for the plots shown in FIG. 7.

The location and shape of the apertures 43 in the top section of the cup-shaped container 40 have a great influence on the melting of the decorations 46. It was confirmed experimentally that the arrangement of forming a large circular opening (not shown) in the central top section of the container 40, tends to heat in excess the central surface portion of the cake as shown by the curve H in FIG. 7, and the provision of apertures in the side section of the container tends to heat in excess the decorations 46. In FIG. 7, numbers 1, 2, 3, . . . , 19 along the X axis correspond to positions in the frozen cake shown in FIG. 8.

The curve H shows temperatures in the cake at these positions 1, 2, . . . , 19 where a single large opening is provided at the center of the upper surface of the container 40. The curve G shows temperatures at these positions where a plurality of openings 43 are provided as illustrated in FIG. 6.

According to the present invention, apertures 43 are formed equidistantly on a circle having a radius such that the dimensions A and B in FIG. 6 are substantially equal. Since a cake is made substantially in a round and symmetric shape, the container 40 is also round in shape and the apertures 43 are formed symmetrically with respect to the center of the container 40, thereby achieving uniform throwing of the cake. By the above-mentioned arrangement of the container 40 and microwave control plate 42, the direction of introducing the microwave energy and the amount of the introduced microwave energy are controlled so that the microwave energy enters the cake 39 only in the vertical direction appropriately, thereby achieving uniform thawing of the cake 39. The container 40 and microwave control plate 42 are preferably made of aluminum which weighs less and is heated only slightly by the high frequency current. Stainless steel is heated to a greater amount by the high frequency current than aluminum, and therefore the heat radiation from the steel container and microwave control plate can adversely affect thawing of the cake.

The following describes the features of the cake tray 41 with reference to FIGS. 5 and 10*a*–10*c*. The cake tray 41 is made of an electrically insulating material with low high-frequency or dielectric loss such as polypropylene, and formed integrally with the microwave control plate 42 in a hermetic structure so that pieces of food and water do not enter the inside of the cake tray 41.

Figure 11:
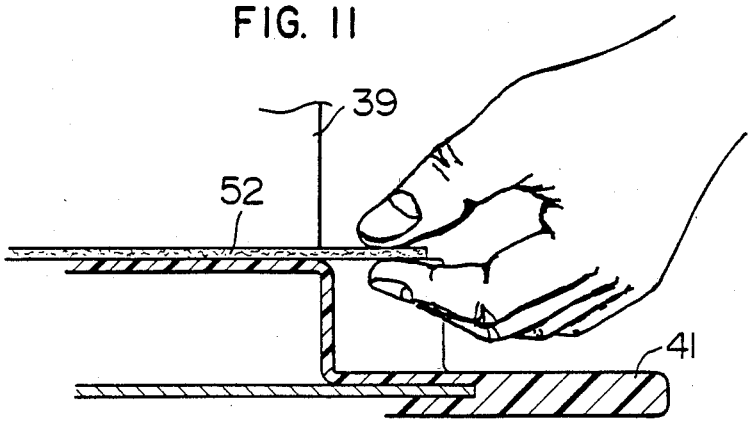
FIG. 11 is an enlarged view showing in part the above cake tray.

The cake tray 41 is designed to have outer dimensions of a length C and a width C, which match the dimensions of the heating chamber 27 so that the cake tray 41 is positioned at a predetermined position within the heating chamber 27. In addition, a portion of the tray 41 where the cake 39 is placed is formd with an annular protrusion 44 having a recess 47 in the central section so that the cake 39 can easily be placed at the center of the tray 41. The protrusion 44 is designed to have a diameter E which is slightly smaller than an inner diameter F of the container 40 shown in FIG. 6, thereby facilitating the positioning of the container 40. The microwave control plate 42 is formed integrally with the cake tray 41, and their spatial relationship is fixed. Accordingly, the primary feature of the cake tray 41 is the formation for maintaining a constant spatial relationship among the heating chamber 27, cake 39, container 40, and microwave control plate 42 so as to achieve the constant thawing performance. The second feature of the cake tray 41 is the formation of the protrusion 44 at the portion where the cake is placed so as to provide a thermal insulation layer of air between the microwave control plate 42 and cake 39. That is, during the thawing process, the microwave energy produced by the magnetrons 30, 30' causes the high frequency current in the microwave control plate 42, which produces the Joule heat. And, if the structure were made so as to allow the heat to transmit directly to the cake 39, the thawing process would be adversely affected. Therefore, according to the present invention, the heat transmission is blocked by the thermal insulation layer of air produced by the protrusion 44 having a height of 11 mm in this embodiment. Another protrusion 48 is formed at the bottom of the cake tray 41 so that the cake 39 is not affected by the heating of the separation board 38 and at the same time the edge of the tray can easily be held by hand when the cake tray 41 is brought into or out of the heating chamber 27. Although this embodiment is arranged to supply the microwave energy from the top and bottom of the chamber, in a case where the microwave energy is supplied only from the top, the microwave control plate 42 which is elevated by the presence of the protrusion 48 allows the microwave energy to pass easily under the microwave control plate 42. In this embodiment, the lower protrusion 48 is designed to have a height of 25 mm. Four recessed sections 49 and 50 formed in both the upward and downward directions are provided as supporters so that the microwave control plate 42 is not deformed. Moreover, recessed sections 51 shown in the figure are provided on the side wall of the protrusion 44 so that the cake 39 can easily be removed from the cake tray 41 after the cake has been thawed. The cake 39 frozen at a temperature of −20° C. before the thawing process can easily be handled, but after it has been thawed, the softened cream on the surface of the cake 39 makes it difficult to hold the cake by hand. According to this embodiment of the invention, the provision of the recessed sections 51 allows a paper dish 52 of the cake 39 to be picked easily by the fingers as shown in FIG. 11 so that the cake 39 can easily be removed from the tray 41.

Since the whole cake tray 41 is formed of an insulator, i.e. polypropylene, there is no fear of sparking between the container 40 and the microwave control plate 42, and between the plate 42 and the interior wall of the heating chamber 27. Thus, the cake tray 41 according to the present invention has numerous outstanding features.

According to the present invention, as described above, the container 40, microwave control plate 42 and cake tray 41 are provided with various functions so as to achieve uniform thawing of the cake 39.

Although in the above embodiment the microwave energy is supplied from the top and bottom of the heating chamber 27, an arrangement whereby the microwave energy is supplied only from the top can achieve a satisfactory thawing by a structure in which sufficient microwave energy is conducted under the microwave control plate 42 and by the adjustment of the dimensions and locations of the apertures 43 in the container 40 and the apertures 45 in the microwave control plate 42.

Figure 12:
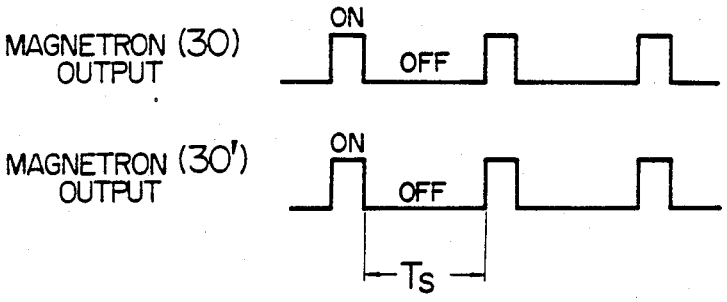
FIGS. 12 and 13 are waveform diagrams showing the oscillation outputs of the magnetrons used in the microwave heater.
Figure 13:
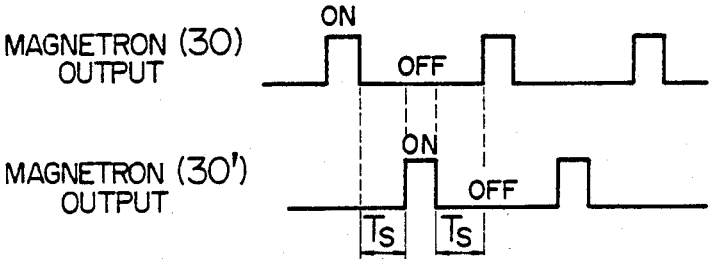
Figure 14:
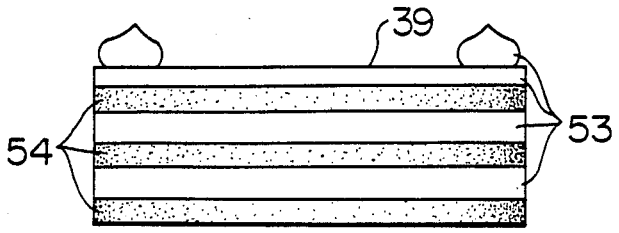
FIG. 14 is a longitudinal cross-sectional view of the cake.

Furthermore, when the magnetrons 30 and 30' are operated intermittently to give inactive periods Ts as shown in FIGS. 12 and 13, the heat is propagated from the surface to the center of the cake during these periods, resulting in a small difference of temperature between the surface and center, and a uniform temperature distribution in the cake can be achieved. The exposure of the cake to the microwave energy supplied from both the top and bottom of the heating chamber is advantageous for heat propagation during the inactive periods as will be described in the following. FIG. 14 shows the cross section of a cake 39, which is usually formed in layers of fresh-cream 53 and sponge cakes 54. The heat on the surface of the cake 39 is propagated to the central portion of the cake through the porous sponge cake sections 54 acting as a thermal insulator, and therefore the heat propagation is obstructed. From the viewpoint of the nature of cakes, the method of supplying the microwave energy from both the top and bottom of the heating chamber is advantageous for thawing the cake enough up to the central section.

The arrangement according to the invention was tested by subjecting a cake of 1600 grams and 28 cm in diameter and frozen at a temperature of −20° C. to the microwave heating for 15 minutes, and the test result is shown by the curve G in FIG. 7. Although the central portions of the cake are left below zero degree, the cake can be cut into divisions without damaging its appearance. When the divided cakes are stored in a show case at around 5° C., portions at a negative temperature reach the same temperature as the rest of the cake in about half an hour. Thus, the total thawing time which has been 8 to 12 hours when the cake is stored in a refrigerator is reduced to about 45 minutes. The above experiment was carried out using cakes having a fresh-cream portion, and therefore the temperature rise at decorations and other sections was severely restricted. However, cakes categorized as sponge cakes can be thawed enough by using only the microwave heating process for about 20 minutes.

Figure 15A:
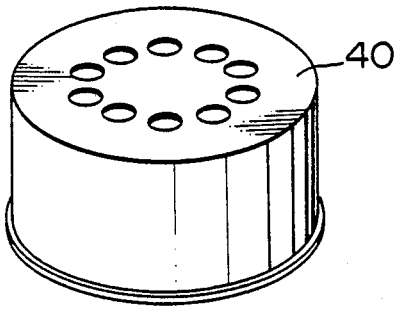
FIGS. 15*a*–15*c* are broken perspective views of the thawing container with the cake according to the present invention.
Figure 15B:
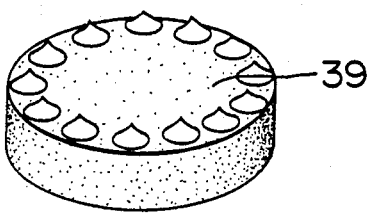
Figure 15C:
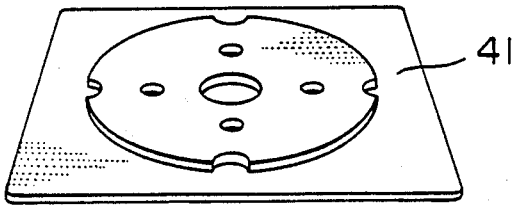

FIG. 7 compares the result of thawing achieved by the present invention and the result obtained by a container having a single large opening. It can be seen from the plots that the result in the arrangement according to the invention causes smaller temperature difference between the highest and lowest temperature portions, that is, $\Delta T = 17°$ C. and this means more uniform thawing of the cake. A fresh-cream starts melting at 20° C. Melting of the fresh-cream was observed on the central surface of the cake when it was thawed by providing the single large opening. FIG. 15*a*–15*c* show perspective views of the container 40, cake 39 and tray 41.

According to the present invention, as described above, a microwave heater which thaws a frozen cake uniformly and in a short time can be realized, and it can be used extensively as a commercial microwave heater installed in hotels and restaurants serving frozen cakes.

What is claimed is:

1. A microwave heater comprising:

a heating chamber for accommodating an object to be heated;

a microwave generator for supplying microwave energy into said heating chamber;

an object supporting tray made of an electrically insulating material with low dielectric loss and having a substantially annular protruding portion for supporting said object;

a metallic microwave control plate having a plurality of apertures, said microwave control plate being securely attached to the bottom of said object supporting tray, the protruding portion of said object supporting tray and said microwave control plate providing therebetween a layer of air for preventing heat conduction from said microwave control plate to said object; and a cup-shaped metallic container having at the top portion thereof a plurality of apertures disposed symmetrically with respect to the center of said top portion and covering said object supported on said object supporting tray, said object supporting tray maintaining a substantially constant spatial relationship among said heating chamber, said cup-shaped metallic container, said object and said microwave control plate.

2. A microwave heater according to claim 1 wherein said microwave generator intermittently supplies microwave energy.

* * * * *